United States Patent [19]

Matsuda

[11] Patent Number: 4,805,509

[45] Date of Patent: Feb. 21, 1989

[54] ELECTRONIC MUSICAL INSTRUMENT CAPABLE OF STORING AND REPRODUCING TONE WAVEFORM DATA AT DIFFERENT TIMINGS

[75] Inventor: Takashi Matsuda, Tokyo, Japan

[73] Assignee: Casio Computer Co., Ltd., Tokyo, Japan

[21] Appl. No.: 147,046

[22] Filed: Jan. 22, 1988

Related U.S. Application Data

[63] Continuation of Ser. No. 923,397, Oct. 27, 1986, abandoned.

[30] Foreign Application Priority Data

Nov. 22, 1985 [JP] Japan ..... 60-261498

[51] Int. Cl.[4] ..... G10H 1/057; G10H 7/00

[52] U.S. Cl. ..... 84/1.01; 84/1.26; 84/1.28

[58] Field of Search ..... 84/1.01, 1.03, 1.19–1.28, 84/DIG. 10

[56] References Cited

U.S. PATENT DOCUMENTS 4,442,745 4/1984 Gross et al. ..... 84/1.01
4,484,506 11/1984 Sato ..... 84/1.01
4,520,708 6/1985 Wachi ..... 84/1.26
4,528,884 7/1985 Kawamoto et al. ..... 84/1.01
4,615,024 9/1986 Usui ..... 84/1.01 X
4,622,877 11/1986 Strong ..... 84/1.01
4,679,480 7/1987 Suzuki ..... 84/DIG. 10

FOREIGN PATENT DOCUMENTS 51-78219 7/1976 Japan .

*Primary Examiner*—Stanley J. Witkowski
*Attorney, Agent, or Firm*—Frishauf, Holtz, Goodman & Woodward

[57] ABSTRACT

An electronic musical instrument has a memory capable of storing musical tone waveform data therein. A read circuit reads out the musical tone waveform data from the memory and supplies the readout data to a musical tone generator. The musical tone generator generates a musical tone signal in accordance with the input musical tone waveform data, and outputs the musical tone signal. A write circuit writes new data in the memory at a timing different from the timing at which the read circuit reads out the musical tone waveform data from the memory. The write circuit partially updates the musical tone waveform data stored in the memory, and stores data of a played sound in part of the memory.

6 Claims, 8 Drawing Sheets

RWAD
CK
11
G6
C
25
AD
RAM
I/O
OE
WE
G3
C
G5
C
INC.
CKT.
+1
18
I5
CK(RWAD)
SAD
CK1
CK2
23
G7
C
G4
C
NR2
NR1
φ1 φ2
CK(ENDAD)
24
COINCIDENCE
CKT.
A5
NA1
φ1
CK
ENDAD
10
I4
WDATA
CK
12
G9
C
CK(WDATA)
R RAM
G8
RDATA
CK
14
φ1
A6
φ2
A7
27
26
MSB
D/A
21
I6
CK
SOUT
R
MSB
22
I7
MULTIPLIER
31
ENVELOPE
COUNTER
29
R2
28
ENVELOPE
CLOCK
GENERATOR
30
STATUS
DETECTOR
TO CPU
R3
DECAY
SUSTAIN
RELEASE

FIG. 2
| ADDRESS | DATA |
|---|---|
| 0 | 11000000 |
| 1 | 11100000 |
| 2 | 10100000 |
| 3 | 10000000 |
| 4 | 01000000 |
| 5 | 00100000 |
| 6 | 10000000 |
| 7 | 01100000 |
FIG. 3
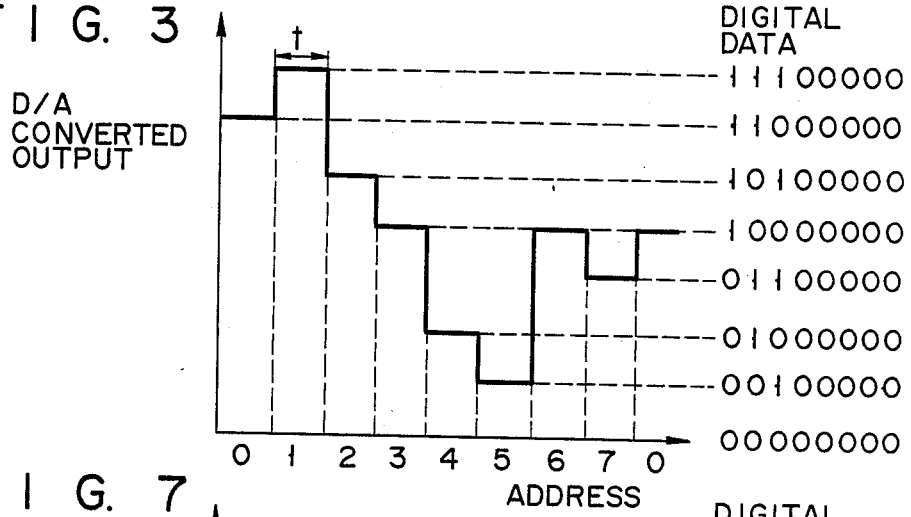
FIG. 7
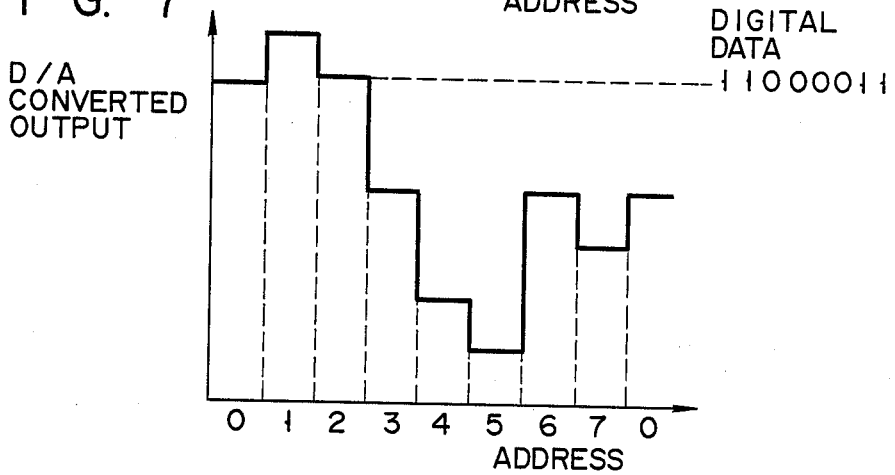

| ADDRESS | DATA |
|---|---|
| 8 | G4 KEY ON |
| 9 | QUARTER NOTE TONE LENGTH |
| 10 | G4 KEY OFF |
| 11 | E4 KEY ON |
| 12 | QUARTER NOTE TONE LENGTH |
| 13 | E4 KEY OFF |
| 14 | C5 KEY ON |
| 15 | HALF NOTE TONE LENGTH |
| 16 | C5 KEY OFF |

ELECTRONIC MUSICAL INSTRUMENT CAPABLE OF STORING AND REPRODUCING TONE WAVEFORM DATA AT DIFFERENT TIMINGS

This application is a continuation, of application Ser. No. 923,397, filed Oct. 27, 1986, now abandoned.

BACKGROUND OF THE INVENTION

The present invention relates to an electronic musical instrument for reading out musical tone waveform data from a memory and generating a musical sound corresponding to a designated pitch.

In a conventional electronic musical instrument, generally, a musical tone waveform corresponding to one period is permanently stored in advance in a memory. The stored musical tone waveform is read out and a musical tone signal corresponding to the pitch is generated.

In another conventional electronic musical instrument, musical tone data, such as pitch or tone length data, corresponding to a played musical sequence is stored. In this case, a "sequencer" memory is provided in addition to a memory for storing the musical tone data.

In the former electronic musical instrument, the content of the memory is permanently stored, and signal processing is performed with a predetermined hardware configuration. Thus, signal processing lacks flexibility.

In the latter electronic musical instrument, a separate memory is used to store musical tone data, incurring a high cost.

SUMMARY OF THE INVENTION

It is an object of the present invention to provide an electronic musical instrument wherein data is written in memory means at a timing different from a read timing for reading out musical tone waveform data from the memory means storing the same, in order to effectively use the memory means.

According to the present invention, there is provided an electronic musical instrument comprising memory means capable of storing musical tone waveform data therein, a read circuit for reading out the musical tone waveform data from the memory means, a musical tone generator for generating a musical tone signal in accordance with the musical tone waveform data read out by the read circuit, and a write circuit for writing new data in the memory means at a timing different from a timing at which the read circuit reads out the musical tone waveform data from the memory means.

BRIEF DESCRIPTION OF THE DRAWINGS

FIG. 2 shows an example of musical tone waveform data which is written in RAM 25 shown in FIG. 1B;

FIG. 3 shows a musical tone waveform corresponding to the data shown in FIG. 2;

FIGS. 4A to 4Q are timing charts for explaining an operation for reading out data from the circuit of RAM 25 shown in FIGS. 1A and 1B, in which FIG. 4A shows the waveform of an output from an ONF latch, FIG. 4B shows an output from inverter I2, FIG. 4C shows the waveform of an output from gate G4, FIG. 4D shows an output from coincidence circuit 24, FIG. 4E shows the waveform of an output from AND gate A5, FIG. 4F shows an output from gate G5, FIG. 4G shows the waveform of an output from inverter I4, FIG. 4H shows an output from gate G3, FIG. 4I shows the waveform of an output from AND gate Al, FIG. 4J shows an output from AND gate A2, FIG. 4K shows the waveform of an output from gate G7, FIG. 4L shows an output from inverter I3, FIG. 4M shows the waveform of an output from increment circuit 18, FIG. 4N shows an output from SAD latch 23, FIG. 40 shows the waveform of an output from SOUT latch 22, FIG. 4P shows the waveform of clock signal $\phi 1$, and FIG. 4Q shows the waveform of clock signal $\phi 2$;

FIGS. 5A to 5G are timing charts of an operation for storing waveform data in RAM 25, in which FIG. 5A shows the waveform of an output from CPU 2, and FIGS. 5B to 5G show the waveforms of output signals CK(RWAD), CK(WDATA), CK(WK), CK(STAD), CK(RTAD), and CK(ENDAD), respectively from operation decoder 4;

FIGS. 6A to 6M are timing charts for explaining an operation for updating data stored in RAM 25, in which FIG. 6A shows the waveform of clock $\phi 1$, FIG. 6B shows clock $\phi 2$, FIG. 6C shows the waveform of an output from a RWAD latch, FIG. 6D shows the waveform of output signal CK(RWAD) from operation decoder 2, FIG. 6E shows an output from a WDATA latch, FIG. 6F shows the waveform of output signal CK(WDATA) from operation decoder 2, FIG. 6G shows the waveform of an output from WF latch 6, FIG. 6H shows the waveform of output signal CK(WF) from operation decoder 2, FIG. 6I shows the waveform of an output from AND gate A2, FIG. 6J shows an output from AND gate A3, FIG. 6K shows the waveform of an output from gate G9, FIG. 6L shows an output from gate G6, and FIG. 6M shows the waveform of an output from NAND NAl;

FIG. 7 is a waveform chart corresponding to an example of data which is updated in accordance with FIGS. 6A to 6M;

FIGS. 9A to 9M are timing charts for explaining an operation for writing data in an empty area of RAM 25, in which FIG. 9A shows the waveform of clock $\phi 1$, FIG. 9B shows the waveform of clock $\phi 2$, FIG. 9C shows the waveform of an output from an RWAD latch, FIG. 9D shows the waveform of output signal CK(RWAD) from operation decoder 4, FIG. 9E shows an output from a WDATA latch, FIG. 9F shows the waveform of output signal CK(WDATA) from operation decoder 2, FIG. 9G shows the waveform of an output from WF latch 6, FIG. 9H shows the waveform of output signal CK(WF) from operation decoder 4, FIG. 9I shows the waveform of an output from AND gate A2, FIG. 9J shows an output from AND gate A3, FIG. 9K shows the waveform of an output from gate G9, FIG. 9L shows an output from gate G6, and FIG. 9M shows the waveform of an output from NAND NAl.

DETAILED DESCRIPTION OF THE INVENTION

An electronic musical instrument according to an embodiment of the present invention will be described with reference to the drawings.

Assume that the electronic musical instrument has first and second modes.

The first mode is the mode for writing predetermined musical tone waveform data in a RAM, conducting a performance by reading out the written data from the RAM, and changing the tone color (timbre) in the course of play (e.g., a switching point from an attack to a decay) by updating the musical tone waveform data.

An operation for reading out data written in a RAM in the first mode will first be described together with the arrangement of the electronic musical instrument with reference to FIGS. 1A and 1B and 4A to 4Q.

Figure 1A:
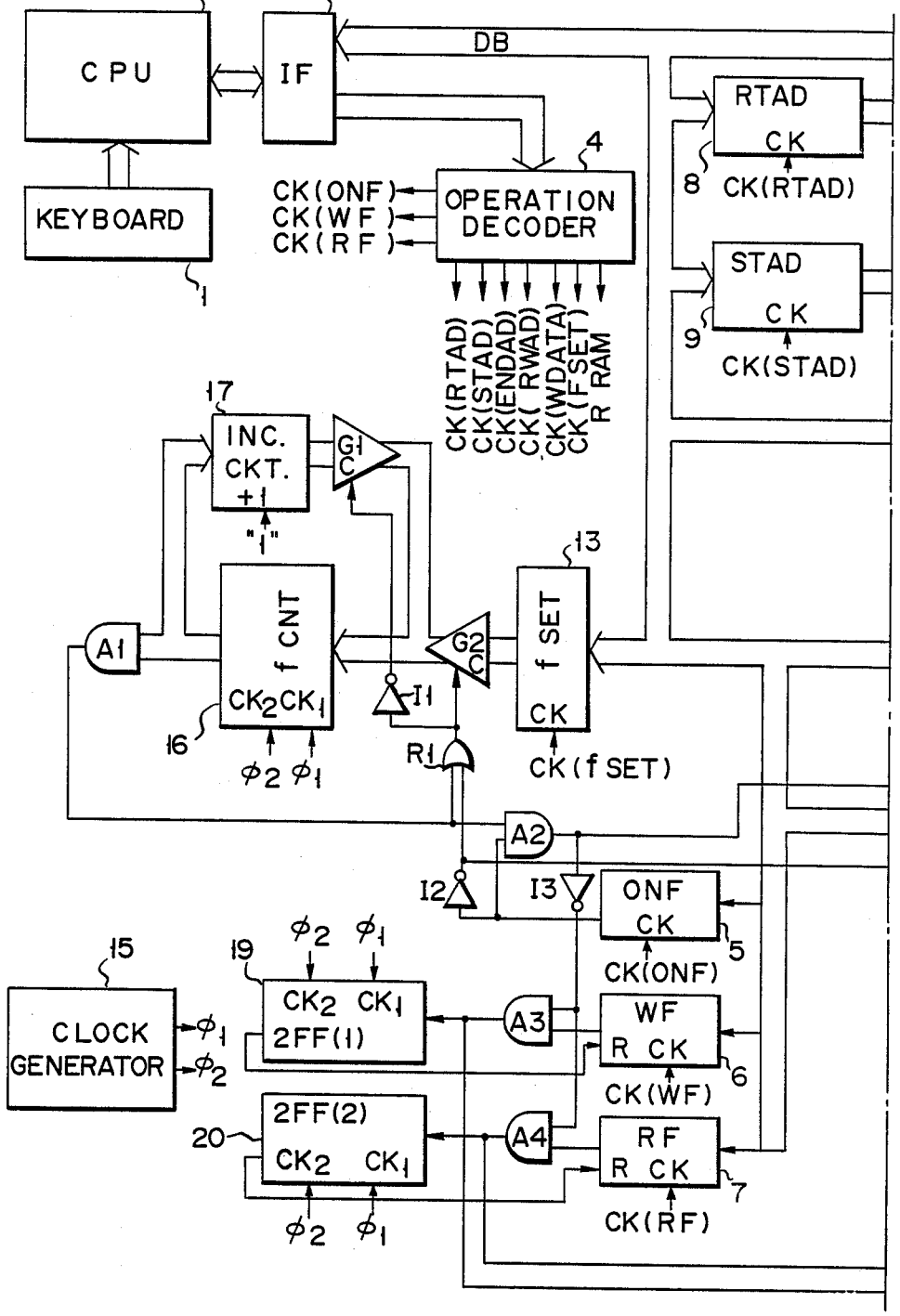
FIGS. 1A and 1B are block diagrams that are combined to show the configuration of an electronic musical instrument according to an embodiment of the present invention.
Figure 1B:
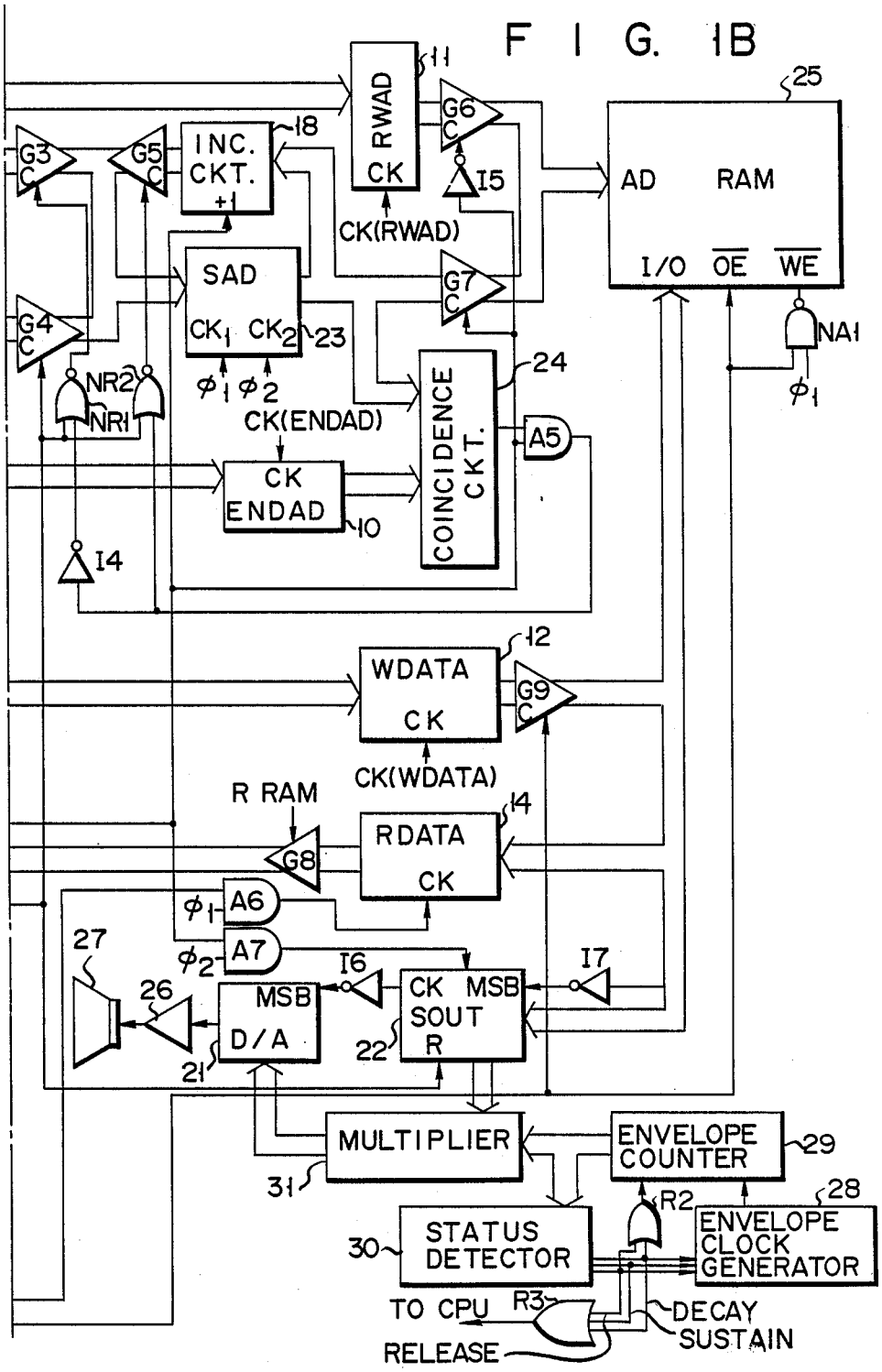

Referring to FIGS. 1A and 1B, keyboard 1 comprises scale keys and various types of control keys (e.g., a tone color selection key). Outputs from the respective keys of keyboard 1 are input to CPU (central processing unit) 2. More specifically, CPU 2 serves as a controller for detecting ON/OFF of keys of keyboard 1 and performing processing corresponding to the key operations.

Interface 3 enables smooth data exchange between CPU 2 and other circuits. Interface 3 performs data control from CPU 2 to various latches and vice versa, and so on.

Operation decoder 4 decodes an instruction from CPU 2 and outputs various type clocks such as latch clock CK (ONF latch 5), CK (WF latch 6), CK (RF latch 7), CK (RTAD latch 8), CK (STAD latch 9), CK (ENDAD latch 10), CK (RWAD latch 11), CK (WDATA latch 12), and CK (fSET latch 13), and a gate control signal (RRAM). CPU 2 supplies onto data bus DB data that is to be latched in the various latches (latches such as RTAD latch 8, STAD latch 9, and ONF latch 5 that receive data from data bus DB). When data is supplied onto bus DB, CPU 2 supplies an instruction to operation decoder 4 so that decoder 4 outputs a corresponding latch clock. Upon this operation, arbitrary data can be set in an arbitrary latch for receiving data from bus DB. CPU 2 also outputs signal RRAM to decoder 4 so as to open gate G8. When gate G8 is opened, CPU 2 can read data in RDATA (Read DATA) latch 14.

Gates G1 to G9 are tristate buffers. When gates G1 to G9 receive input C of level "1", they output the received inputs unchanged. When gates G1 to G9 receive input C of level "0", their outputs are disabled (high impedance).

Figure 4:
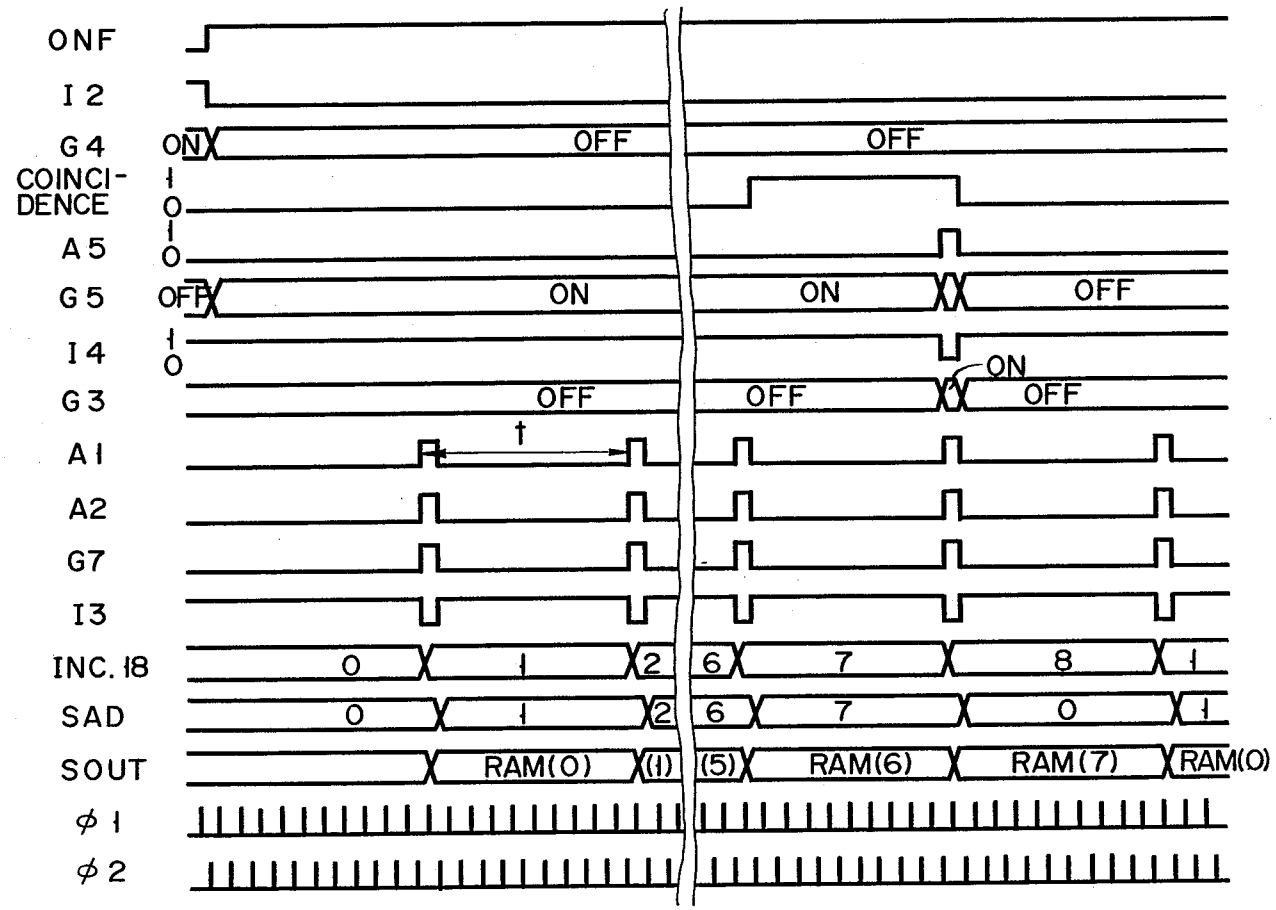
Figure 5:
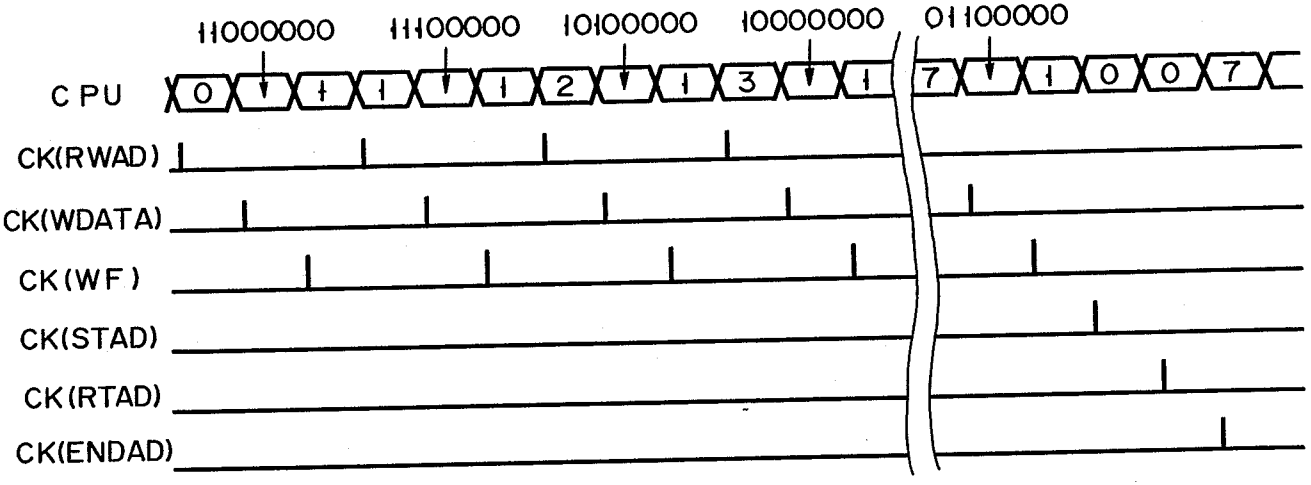

Clock generator 15 alternately outputs two pulses $\phi 1$ and $\phi 2$ (see FIGS. 4P and 4Q).

All the clocks CK output from decoder 4 have a period of $\phi 2$.

RAM 25 stores musical tone waveform data. For example, FIG. 2 shows musical tone waveform data consisting of eight 8-bit data. FIG. 3 shows an analog waveform obtained when data shown in FIG. 2 is read out at every period t where t is a time determining an interval. When t is doubled, a sound lower than the original sound by one octave is generated; when t is multiplied by $\frac{1}{2}$, a sound higher than the original sound by one octave is generated.

A scale clock generator comprising fSET latch 13, fCNT latch 16, increment circuit 17, and so on adjusts period t determining the scale. ONF latch 5 is set at level "1" when the electronic musical instrument produces a sound, and at level "0" when it does not produce a sound. When no sound is produced, an output from latch 5 is set at level "0". The output from latch is supplied to gate G2 through inverter I2 and OR gate R1 as a control signal. An output from latch 5 is also supplied to gate G1 through gate R1 and inverters I1 and I2 as a control signal. The output from latch 5 is further supplied to AND gate A2 together with an output from AND gate A1. An output from gate A2 is supplied to AND gates A3 and A4 through inverter I3, and is also supplied to AND gate A7 together with clock $\phi 1$. The output from gate A2 is also supplied to control terminal C of gate G7 and AND gate A5 and, at the same time, applied to increment circuit 18 as a +1 signal. The output from gate A2 is also supplied to control terminal C of gate G6 through inverter I5. When a certain scale key of keyboard 1 is depressed, CPU 2 sets corresponding data (data corresponding to period t) in latch 13.

In an initial state, an output from latch 5 is at level "0" (no-sound state) (FIG. 4A), and an output from inverter I2 is thus at level "1" (FIG. 4B). Therefore, an output from OR gate R1 is set at level "1", gates G2 and G1 are turned on and off, respectively, and data of latch 13 is loaded in latch 16.

For example, assume that the data set in latch 13 is 80 (H) (hexadecimal code). Then, an output from latch 16 is also 80 (H), and an output from gate A1 is set at level "0". Subsequently, CPU 2 sets latch 5 at level "1" (FIG. 4A). An output from OR gate R1 is then set at level "0" (FIG. 4B), and gates G2 and G1 are turned off and on, respectively. Increment circuits 17 and 18 increment input data by one and output the resultant data when they receive input "1" at +1 terminals thereof. Increment circuit 17 always increments input data thereto since an input thereto at its +1 terminal is always set at level "1". Therefore, 81 (H) is read by latch 16, in response to pulse $\phi 1$ immediately after latch 5 is set at level "1" and it is output in response to next clock $\phi 2$. 82 (H) is read by latch 6 in response to next clock $\phi 1$ and is output in response to clock $\phi 2$. This operation is repeated. When FF (H) is output from FCNT latch 16, output of gate A1 is set at level "1" (FIG. 4I), gates G1 and G2 are turned off and on, respectively, and 80 (H) is loaded again in latch 16. Thereafter, the obtained data are sequentially incremented by one. When this operation is repeated, the output from gate A1 becomes a timer output for generating a one-shot "1" signal at a period between 80 (H) and FF (H) (FIG. 4I). The output period of gate A1 corresponds to t shown in FIG. 3.

Latches having two clock terminals CK1 and CK2, such as fCNT latch 16, 2FF(1) latch 19 for receiving an output from gate A3, and 2FF(2) latch 20, are bistable flip-flops. Each of these flip-flops reads data at terminal CK1 and outputs data at terminal CK2. Note that outputs from latches 19 and 20 are input to reset input terminals R of WF (Write Function) and RF (Read Function) latches 6 and 7, respectively. When latch 5 is set at level "0", an output from inverter I2 is set at level "1", input R to SOUT (Sound OUT) latch 22 is set at level "1", and an output from latch 22 is "00 . . . 0". Note that reference symbols R of latches 22, 6, 7 and so on denote reset inputs. The MSB of the output from latch 22 is input to D/A converter 21 through inverter I6. Therefore, when latch 5 is set at level "0", an output from converter 21 is at a medium potential. The output of gate A4 is input to gate A6 together with clock $\phi 1$. The outputs of gates A6 and A7 are input to latches 14 and 22 as clocks, respectively. The reset signal of latch 22 is an output from inverter I2.

The start address of RAM 25 for starting readout of a waveform, the end address thereof for ending readout, and the return address thereof for returning, after the end address, to the start address to start readout, are sequentially set in STAD (STart ADdress), ENDAD (END ADdress), and RTAD (ReTurn ADdress) latches 9, 10 and 8, respectively. CPU 2 sequentially increments the addresses of RAM 25 from the start address to read out data at the start address to end address, returns to the return address, and reads out data again as far as the end address in the incrementing order of the address. This operation is repeated until latch 5 is set at level "0".

An output from inverter I2 is applied to the control terminal of gate G4. An output from inverter I2 is applied to control terminals of gates G3 and G5 through NOR gates NR1 and NR2. Therefore, when latch 5 is set at level "0", the output of inverter I2 is set at level "1", gate G4 is turned on, and gates G3 and G5 are turned off (FIGS. 4A, 4B, 4C, 4F, and 4H). While gate G4 is on, start address data from latch 9 is loaded in bistable F/F flip-flop SAD (Set ADdress) latch 23 through gate G4. In this case, data from latch 13 is loaded in latch 16, as mentioned before.

Coincidence circuit 24 outputs a "1"-level signal when an output from ENDAD latch 10 coincides with that from SAD latch 23 (FIG. 4D). In the initial state, the output of coincidence circuit 24 is set at level "0" since no coincidence is established between the start address data and the end address data of latch 23. The output from coincidence circuit 24 is input to gate A5.

Assume that an output from latch 5 is set at level "1". Then, the output of inverter I2 is set at level "0", and gate G4 is turned off (FIGS. 4A, 4B and 4C). The output from coincidence circuit 24 is kept at level "0", the output from gate A5 is set at level "0", the output from NOR gate NR2 is set at level "1", and gate G5 is turned on. At the same time, the output from inverter I4 is set at level "1", and gate G3 is turned off. Then, the output of latch 23 is incremented by one by increment circuit 18 and input again to latch 23. Immediately after the output of latch 5 is set at level "1", the data of latch 16 has only begun being incremented and has not yet reached "FF", and the outputs of gates Al and A2 are also set at level "0" (FIGS. 4I and 4J). Therefore, a "0" signal is supplied to the +1 input terminal of increment circuit 18, and the data of latch 23 is thus not incremented (FIG. 4M). The R input to latch 22 is set at level "0" when the output of latch 5 is set at level "1". However, since the output of gate A2 is set at level "0", the output from gate A7 is set at level "0" and no "1" signal is supplied to terminal CK of latch 22. Therefore, the output from converter 21 is kept at the medium potential. Note that converter 21 is connected in series with amplifier 26 and speaker 27.

When the data of latch 16 becomes "11 . . . 1" (FF), the output from gate Al is set at level "1" (FIG. 4I), the output from gate A2 is set at level "1" (FIG. 4J), and a "1" signal is supplied to the +1 input terminal of increment circuit 18. At the same time, gate G7 is turned on (FIG. 4K), and the data (FIG. 4N) of latch 23 is supplied to address input terminal AD of RAM 25. Since the output of gate A2 is set at level "1", the output from inverter I3 is set at level "0" (FIG. 4L). The output from gate A3 is set at level "0", and an input to the $\overline{OE}$ terminal of RAM 25 is set at level "0". When the "0" signal is applied to the $\overline{OE}$ terminal, $\overline{RAM}$ 25 outputs data from its I/O terminals. As a result, the data of the SAD address (in this case, start address) of RAM 25 is output from the I/O terminals of RAM 25. At this time, when the output of gate A2 is set at level "1", one-shot clock pulse $\phi 1$ is output from gate A7, and the digital data of RAM 25 is read in latch 22 (FIG. 40) The read data is D/A converted by D/A converter 21 and is produced through amplifier 26 and speaker 27. In other words, analog signals corresponding to the data stored at address 0 in RAM 25 are produced.

Meanwhile, the data incremented by one by increment circuit 18 is read by latch 23 upon application of clock pulse $\phi 1$ (FIG. 4N).

Thereafter, every time the data of latch 16 becomes "11 . . . 1" (i.e., every time period t elapses), the data of latch 23 is input to address input terminal AD of RAM 25 through gate G7. When a "0" signal is supplied to the $\overline{OE}$ terminal of RAM 25, the data of corresponding address is output through its I/O terminals. When a pulse is supplied to terminal CK of latch 22, the corresponding data is latched by latch 22 (FIG. 40). The output data of latch 22 is then produced through converter 21, amplifier 26, and speaker 27. Note that the MSB of the data output from RAM 25 is latched by latch 22 through inverter I7. Every time the series of above operation is performed, the data from latch 23 is incremented by one so that the data is finally equal to the end address data (FIG. 4N). In this state, when the above-mentioned series of operations are performed, the output of coincidence circuit 24 is set at level "1", and that of gate A2 is also set at level "1". Therefore, the output from gate A5 is set at level "1" (FIG. 4E), the output from NOR gate NR2 is set at level "0" to turn off gate G5 (FIG. 4F), the output from inverter I4 is set at level "0" (FIG. 4G), the output from NOR gate NR1 is set at level "1", and gate G3 is turned on (FIG. 4H). Upon this operation, the data of the end address is latched by latch 22, and that of the return address is latched by latch 23. In the next timing, the content of the return address of RAM 25 is read out.

Thereafter, data from the return address to end address is repeatedly output until latch 5 is set at level "0".

An operation for updating waveform data while reading out the waveform data from RAM 25 will be described.

Waveform data write, i.e., waveform data updating of RAM 25 is performed while no data is read out therefrom and at a switching time of an envelope status, i.e., a switching time from attack to decay or from decay to sustain.

For this purpose, envelope clock generator 28 is provided. Generator 28 generates an envelope clock at a rate corresponding to the envelope status and supplies it to envelope counter 29. Counter 29 counts the number of clocks of the input signal. Data output from counter 29, i.e., envelope data is supplied to envelope status detector 30 and multiplier 31. Detector 30 detects an envelope status, i.e., switching among attack, decay, sustain, and release. Multiplier 31 multiplies the output from counter 29 by the waveform data supplied from latch 22, and supplies the product, i.e., a musical tone signal to converter 21. The output from detector 30 is input to counter 29 through OR gate R2 to cause it to perform subtraction for decay and release. The output from detector 30 is also input to CPU 2 through OR gate R3.

An operation for writing data by CPU 2 into RAM 25 will be described with reference to the timing charts of FIGS. 5A to 5G.

When a timbre switch (not shown) is turned on, CPU 2 reads out corresponding musical tone data from a memory (not shown). In this case, assume that a timbre switch corresponding to the data shown in FIG. 2 is turned on. CPU 2 outputs address 0 (FIG. 5A), causes decoder 4 to output signal CK(RWAD) (FIG. 5B), and sets address 0 in RWAD (Read/Write ADdress) latch 11. Subsequently, CPU 2 outputs data "11000000" (FIG. 5A), causes decoder 4 to output clock CK(WDATA) (FIG. 5C), and sets data "11000000" (data at address 0 of FIG. 2) in WDATA (Write DATA) latch 12. CPU 2 then outputs data "1" representing data write (FIG. 5A), causes decoder 4 to output clock CK(WF) (FIG. 5D), and sets WF latch 6 at level "1". The output from gate A3 is set at level "1" at a cycle immediately after latch 6 is set at level "1". Therefore, gate G9 is turned on, and data "11000000" of latch 12 is input to the I/O terminals of RAM 25. Simultaneously, a "1" signal is applied to terminal $\overline{OE}$ of RAM 25, and a low level active pulse having a period of $\phi 1$ is input to the $\overline{WE}$ terminal of RAM 25 through NAND gate NAl. In this case, since gates G7 and G6 are turned off and on, respectively, data is written in RAM 25 at address "0" designated by latch 11. Data write cycle by CPU 2 into RAM 25 is set to one cycle by 2FF(1) latch 19.

Data "11100000" is written at address 1 in RAM 25, and data shown in FIG. 2 is written at up to address 7 in RAM 25 with a relation shown in FIG. 2. Thereafter, CPU outputs data "0", causes decoder 4 to output clock CK (STAD latch 9) (FIG. 5E), and sets start address data "0" in STAD latch 9. Subsequently, CPU 2 outputs data "0", causes decoder 4 to output clock CK (RTAD latch 8) (FIG. 5F), and sets return address data "7" in RTAD latch 8. Thereafter, CPU 2 outputs data "7", causes decoder 4 to output clock CK (ENDAD latch 10), and sets end address data "7" in ENDAD latch 10.

An operation will be described wherein CPU 2 reads data from RAM 25 other than the musical tone waveform data and ONF latch 5 is set at level "0", i.e., the instrument does not produce a sound.

When data "1" is set in RF latch 7 and data "0" is set in WF latch 6, ONF latch 5 outputs data "0", the output of OR gate R1 is set at level "1", and gate G2 is thus turned on. Latch 16 stores pitch data from latch 3. Therefore, gate Al outputs data "0", gate A2 outputs data "0", and inverter I3 outputs data "1". Since gate A4 outputs data "1", clock pulse $\phi 1$ is output from gate A6, and data is fetched by RDATA latch 14. At this time, since gate A2 is set at level "0", gates G7 and G6 are turned off and on, respectively, and data from RWAD latch 11 is supplied to address input terminal AD of RAM 25. The output of gate A3 is set at level "0" in response to a "0"output from latch 6, the $\overline{OE}$ input of RAM 25 is set at level "0", and address data of RWAD latch 11 is output. Thus, when a desired address of RAM 25 is set in latch 11 in advance and data "0" and "1" are set in latches 6 and 7, respectively, data of RAM 25 can be latched by latch 14. Thereafter, CPU 2 causes decoder 4 to output "1" signal RRAM, turns on gate G8, and reads data of latch 14 through data bus DB. Data "1" set in latch 7 is read by latch 20 in response to clock pulse $\phi 1$ which is the same as the read clock for reading into RDATA latch 14. The clock read by latch 14 is output by next clock $\phi 2$ and latch 20 is thus reset. In this manner, two or more read clocks are prevented from being output from latch 14.

On the other hand, when ONF latch 5 is set at level "1", the above operation is performed at a cycle different from the cycle for reading musical tone waveform data by latch 22. In this case, a time from clock pulse $\phi 2$ to next clock pulse $\phi 2$ is defined as a cycle. More particularly, gate Al is set at level "1" only in a cycle for reading out waveform data from RAM 25, and is set at level "0" otherwise. Therefore, the above operation is performed while the output from gate Al is set at level "0".

An operation will be described wherein the waveform (shown in FIG. 3) of the present output supplied from RAM 25 is updated to that shown in FIG. 7 when the envelope status is switched from attack to decay and no waveform data is read out by RAM 25.

Figure 6:
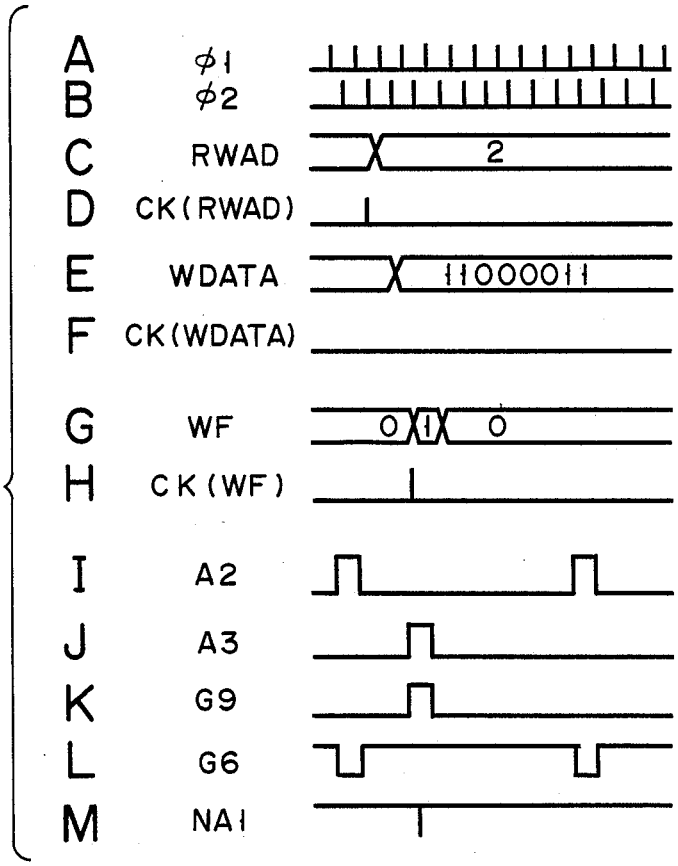

Assume that RAM 25 stores data shown in FIG. 3. When a scale key of keyboard 1 is depressed, CPU 2 sets latch 5 at level "1". Then, the waveform shown in FIG. 3 is output. In this case, since data "0" is set in RTAD latch 8, after data "01100000" at address 7 of RAM 25, data "11000000" at address 0 is output again, and data at addresses 0 to 7 are repeatedly output. Thereafter, when the envelope status is changed to decay, a signal representing the decay is output from detector 30 and is input to an interrupt terminal of CPU 2 through OR gate R3. In the decay, the waveform data at address 2 is different. Then, CPU 2 outputs address data "2", in synchronism with clock $\phi 2$ (FIGS. 6B and 6C). FIG. 6A shows a timing relationship between clock $\phi 2$ and clock $\phi 1$. CPU 2 causes decoder 4 to output signal CK(RWAD) (FIG. 6D), and sets data "2" in RWAD latch 11. After data "2" is set in latch 11, gates A2 and G6 are turned off and on, respectively, and address "2" of latch 11 is supplied to CPU 2 (FIGS. 6I and 6L). Subsequently, CPU 2 outputs data "11000000", causes decoder 4 to output clock CK(WDATA) (FIG. 6F), and sets data "11000011" in WDATA latch 12 (FIG. 6E). After the data "11000011" is set in latch 12, gates A3 and G9 are turned on, and the data of latch 12 is supplied to CPU 2 (FIGS. 6J and 6K). Subsequently, CPU 2 outputs data "1" representing data write, causes decoder 4 to output clock CK(WF) (FIG. 6H), and sets WF latch 6 at level "1" (FIG. 6G). In accordance with this operation, NAND gate NAl outputs a low level pulse to the $\overline{WE}$ terminal of RAM 25 (FIG. 6M), and data "11000011" is written at address 2 in RAM 25. Since this data write utilizes an empty cycle other than waveform data readout cycle, a sound is produced in a normal manner. When SOUT latch 22 reads data at address 2 of RAM 25 after the write operation is completed, since the read data is data "11000011", different from that of the previous cycle, a change occurs in the sound. Thereafter, when the envelope status is changed to sustain or to release, a signal representing sustain or release is output from detector 30 and is input to CPU 2 through gate R3. The data of RAM 25 is hence updated in the manner as described above. Since CPU 2 can arbitrarily update the waveform data being produced in accordance with the change in the envelope status, a waveform which changes over time can be output. The changing manner of the waveform can be arbitrarily selected by CPU 2 and thus a variety of changes can be obtained.

In the above embodiment, the timing for writing new musical tone waveform data in the RAM is set to coincide with the timing at which the envelope status changes. However, the present invention is not limited to this. The timing for writing new musical tone waveform data in the RAM can be determined in accordance with output data from a counter. As a result, since the envelope can be controlled by gradually changing the amplitude of a waveform, the envelope control circuit can be omitted, thereby reducing the circuit scale.

As described above, in the first mode, the musical tone waveform data written in the RAM is read out and a musical tone signal having a frequency corresponding to the pitch is produced. Furthermore, the waveform of the musical sound being produced can be arbitrarily changed by writing a new musical tone waveform signal in the RAM at a timing different from the timing for reading out the musical tone waveform data from the RAM. Therefore, a musical sound which changes over time can be produced, and various types of musical sound can be produced with an inexpensive electronic musical instrument without using a high-speed, large-scale hardware configuration.

A case will be described wherein the second mode is designated. Assume that musical tone waveform data shown in FIG. 2 has already been written in RAM 25 at addresses 0 to 7. An operation will be described with reference to the timing charts of FIGS. 9A to 9M wherein the musical tone data shown in the score of FIG. 8 is written in the empty area at address 8 of RAM 25 and so on while being played, and is reproduced.

Figures 8, 10:
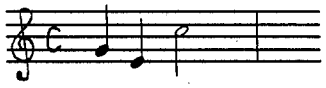
FIG. 8 is a score indicating an example of a performance.
FIG. 10 is a memory map of RAM 25 when the musical tone data of the score shown in FIG. 8 is stored in the empty area of RAM 25 in accordance with the timing charts of FIG. 9.

Note that the musical tone data of the score shown in FIG. 8 that will be written at addresses 8 to 16 in the RAM is as shown in FIG. 10.

CPU 2 first sets data "0"and "7" in STAD and RTAD latches 9 and 8, respectively. Then the produced sound has a waveform which is the repetition of that shown in FIG. 3. No key of keyboard 1 is depressed before a key of pitch G4 of in FIG. 8 is depressed. CPU 2 sets ONF latch 5 at level "0" and waits for a key depression. When a key of pitch G4 is depressed, CPU 2 sets corresponding pitch data in fSET latch 13, and latch 5 at level "1". This starts production of a sound of pitch G4.

Figure 9:
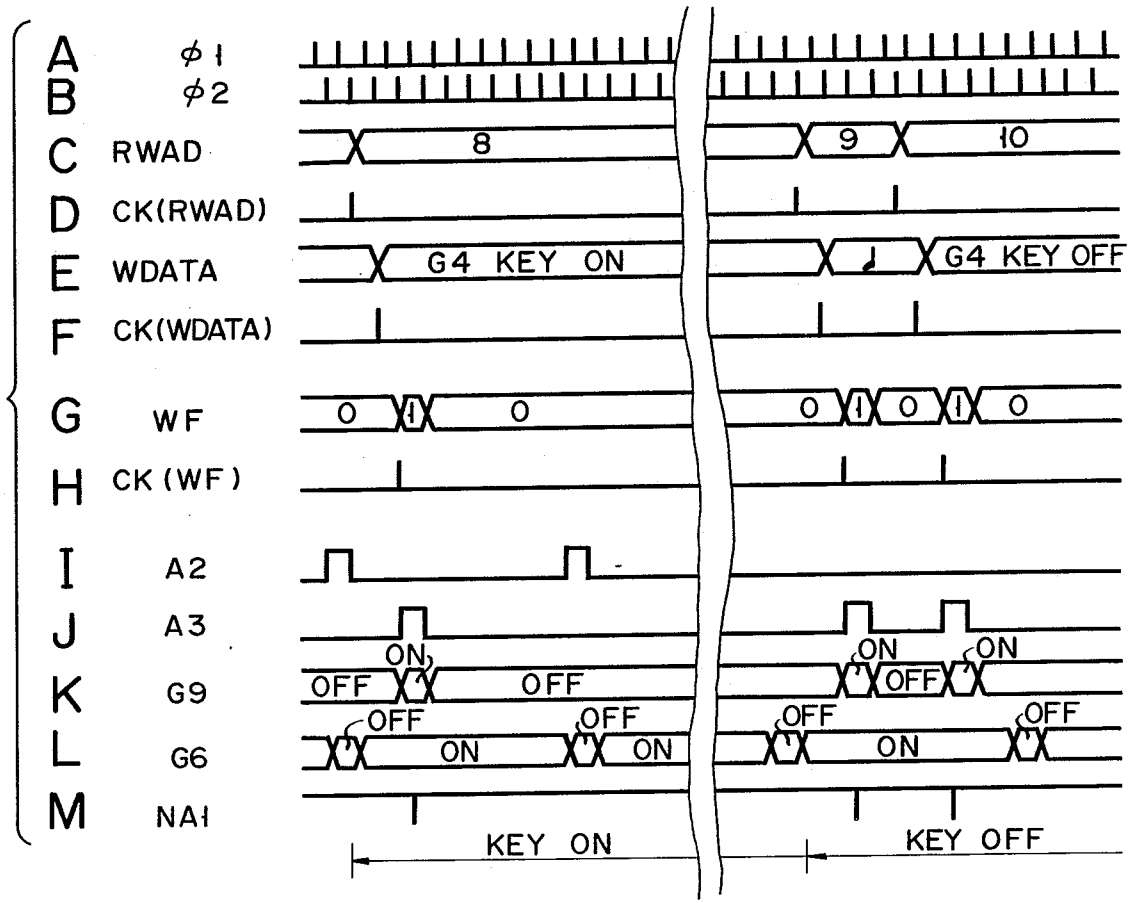

After CPU 2 sets latch 5 at level "1", it outputs address "8" in a timing of clock $\phi 2$ (FIG. 9B). FIG. 9A shows a timing relationship between clock $\phi 2$ and clock $\phi 1$. CPU 2 causes decoder 4 to output clock CK(RWAD) (FIG. 9D), and sets address "8" in RWAD latch 11 (FIG. 9C). Thereafter, address "8" is supplied to RAM 25 (FIGS. 9I and 9L). CPU 2 outputs a key code representing pitch G4, that is, CPU 2 outputs G4 KEY ON data in a timing of clock $\phi 2$ (FIG. 9E). CPU 2 causes decoder 4 to output clock CK(WDATA) (FIG. 9F), and sets G4 code data in WDATA latch 12. Then data is supplied to the I/O terminals of RAM 25 (FIGS. 9J and 9K). CPU 2 outputs WF data "1" in a timing of clock $\phi 2$ (FIG. 9G). CPU 2 causes decoder 4 to output clock CK(WF) (FIG. 9H), and sets WF latch 6 at level "1". Then, NAND gate NAl outputs a low-level clock (FIG. 9M) at an initial cycle at which the waveform of RAM 25 is not read out in SOUT latch 22, and the data of WDATA latch 12 is written at address "8" in RAM 25.

A time corresponding to a quarter note tone length elapses an the key of pitch G4 is released. Then, CPU 2 sets latch 5 at level "0" and stops producing a sound of pitch G4. Thereafter, CPU 2 performs the similar operation to set data "9" in latch 11, a tone length code representing a quarter note in latch 12, and data "1" in latch 6. The quarter note code is written at address 9 in RAM 25. When this code writing is completed, CPU 2 sets data "10" in latch 11, data in latch 12 that indicates that the key of pitch G4 is released, and data "1" in latch 6. In practice, since RAM 25 is accessed sufficiently fast compared to the processing time of CPU 2, only one NOP (no operation) must be performed for waiting write completion at address 9 of RAM 25. Thereafter, the same operation is performed for the second and third sounds having pitches E4 and C5, respectively. When the performance is completed, the data in RAM 25 is as shown in FIG. 10.

An operation for reproducing a musical piece stored in RAM 25 will be described.

Data "0" is set in ONF latch 5 before reproduction. When reproduction is started, CPU 2 sets data "8" in RWAD latch 11, data "1" in RF latch 7, and data "0" in RDAT latch 14, and waits until that data (i.e., key off code of pitch G4) is written at address 8 in RAM 25. This operation is sufficiently performed within a time period of one NOP. Subsequently, CPU 2 causes decoder 4 to output signal RRAM to enable gate G8, and latches data of RDATA latch 14. CPU 2 then decodes the fetched data representing a pitch G4 key ON code, and sets pitch data indicating pitch G4 in fSET latch 13 and data "1" in latch 5. CPU 2 then sets data "9" in latch 11 and data "1" in latch 7. The data (quarter note code) at address 9 of RAM 25 is read by latch 14 at the first cycle which is not the read cycle of SOUT latch 22. The read completion by RWAD latch 2 is delayed (one NOP), and CPU 2 causes decoder 4 to output signal RAM and fetch data of RDATA latch 12. CPU 2 then decodes the fetched data and waits for the quarter note time lapse. After the lapse of the quarter note time, CPU 2 sets data "10" and "1" in latches 11 and 7, respectively, performs NOP once and causes decoder 4 to output signal RRAM. As a result of this, a pitch G4 key OFF code at address 10 of RAM 25 is read by CPU 2. CPU 2 decodes the read data, sets data "0" in ONF latch 5, and stops production of a sound of pitch G4.

The stored performance is reproduced in the above manner.

As described above, even while the waveform of a musical tone is read out from RAM 25 and produced, an empty area of RAM 25 can be used for another application without influencing the produced sound.

As described above, in the electronic musical instrument, in the second mode, the musical tone waveform data written in the memory is read out and a corresponding musical sound is generated and produced. At the same time, musical tone data, such as pitch data and tone length data, is written in an empty area of the memory at a timing different from a timing for reading out the musical tone waveform data from the memory. Therefore, no additional memory is needed.

The above embodiment exemplifies a monophonic circuit for the sake of simplicity. However, a polyphonic circuit can be provided by using a time-division circuit.

A RAM is used as a memory means. However, another memory means, from which data can be read out or in which data can be written, such as a floppy disk, can be used instead.

As described above, in the present invention, data is written in a memory means storing musical tone waveform data at a timing different from a timing for reading out the musical tone waveform data from the memory means, thereby effectively utilizing the memory means.

What is claimed is:

1. An electronic musical instrument, comprising:

memory means capable of storing musical tone waveform data of at least one period of a tone waveform therein;

read circuit means for reading out the musical tone waveform data repetitively from said memory means;

musical tone generator means for generating a musical tone signal in accordance with the musical tone waveform data read out by said read circuit means; and write circuit means which, when a musical tone signal is generated from said musical the generator means, writes musical tone waveform data into any address of a memory area in which the repetitively read-out musical tone waveform data is stored, the write operation being performed at a timing different from a timing at which the musical tone waveform data is read by the read circuit means out of said memory means.

2. An instrument according to claim 1, wherein said memory means includes means for storing an amplitude of a waveform.

3. An instrument according to claim 2, wherein said write circuit means comprises:

means for detecting a change of a status of an envelope; and means for writing said tone waveform data into said memory means when the status of the envelope is changed.

4. An instrument according to claim 2, wherein said memory means is arranged to store start, return and end addresses wherein musical tone waveform data is read out from the start address to the end address, and thereafter, the waveform data is read-out from the return address to the end address, and said read circuit means comprises means for repeatedly reading out the musical tone waveform data in accordance with the data stored in said memory means.

5. An electronic musical instrument comprising:

memory means capable of storing musical tone waveform data of at least one period of a tone waveform therein;

read circuit means for reading out the musical tone waveform data from said memory means;

musical tone generator means for generating a musical tone signal in accordance with the musical tone waveform data read out by said circuit means; and write circuit means for writing the musical tone data, including at least one of pitch data and tone length data, into said memory means at a timing different from a timing at which said read circuit means reads out the musical tone waveform data from said memory means while a musical tone signal is generated from said musical tone generator means.

6. An instrument according to claim 5, wherein said write circuit means comprises means for writing musical tone data in an unoccupied area of said memory means.

* * * * *